United States Patent [19]

Gould

[11] 4,266,706

[45] May 12, 1981

[54] BELT SUPPORT FOR CAMERAS

[76] Inventor: Arthur Gould, 1690 W. 6 St., Reno, Nev. 89503

[21] Appl. No.: 156,535

[22] Filed: Jun. 5, 1980

[51] Int. Cl.[3] ..... A45F 5/02

[52] U.S. Cl. ..... 224/253; 224/249; 224/908; 150/52 J; 206/316

[58] Field of Search ..... 224/253, 250, 254, 240, 224/249, 904, 908, 208, 242, 58; 24/79; 248/104; 206/316 R; 150/52 J

[56] References Cited

U.S. PATENT DOCUMENTS

| | | | |
|---|---|---|---|
| 1,022,791 | 4/1912 | Laird, Jr. | 224/249 |
| 2,112,339 | 3/1938 | Kasparek | 224/249 |
| 2,661,129 | 12/1953 | Seaton et al. | 224/247 |
| 2,894,119 | 7/1959 | Stenger | 248/231 |
| 3,130,803 | 4/1964 | Wiggins | 46/256 X |
| 3,369,723 | 2/1968 | Saari et al. | 224/250 X |
| 3,635,430 | 1/1972 | Emond et al. | 224/249 X |
| 3,813,017 | 5/1974 | Pimsleur | 224/240 |
| 4,120,434 | 10/1978 | Hewes | 224/249 |

*Primary Examiner*—Steven M. Pollard
*Attorney, Agent, or Firm*—Ladas & Parry

[57] ABSTRACT

This invention relates to a substantially rectangular camera support made of an elastic or other stretchable material such as rubber having a pair of transverse slots (13) disposed inwardly from the edges to form a pair of flaps (14) and a median center strip (15) forming the central portion of the holder (10). The slots (13) are so dimensioned as to support the holder (10) on the belt (16) and to securely cradle the camera between the two elastic flaps (14).

6 Claims, 3 Drawing Figures

BELT SUPPORT FOR CAMERAS

DESCRIPTION

1. Technical Field

My invention relates to camera supports and, more specifically, to a holder for supporting a camera on a belt when the same is worn by a user.

2. Background Art

Previous devices for supporting a camera on the belt of a user have either been belt clips which worked their way up disastrously, cumbersome cases which were bulky and did not provide for use of long lenses, or complex devices which relied on friction to hold the camera. Accordingly, there was a need for an extremely simple, versatile, secure means of attaching a camera to the belt of a user.

There have been numerous efforts to provide belt supports for cameras and various other articles as exemplified by references: U.S. Pat. Nos.: 2,308,003, 3,158,300, 3,209,968, 3,294,298, 3,369,723, 3,450,317, 3,521,241, 3,762,616, 3,813,017, and 4,120,434.

DISCLOSURE OF THE INVENTION

In accordance with the present invention, I provide a holder for supporting a camera of the type having laterally extended body portions on a belt when worn by a user, said holder comprising a strip-like member of elastic material provided with a pair of slots dimensioned to receive a belt therethrough with each of said slots also being adapted to simultaneously receive a corresponding one of the extending body portions of a camera whereby a camera can be firmly gripped and supported on a user's belt.

My holder provides means for easily and securely supporting a camera on the belt of a user.

Further, this holder will accept cameras of different sizes and manufacture as well as cameras provided with short lenses or cameras having an unlimited variety of long or zoom lenses. In this latter case, the holder can be pivoted on the belt of a user such that the camera is in a downward position so said long lenses will hang naturally out of the way.

DETAILED DESCRIPTION OF THE INVENTION

Figure 1:
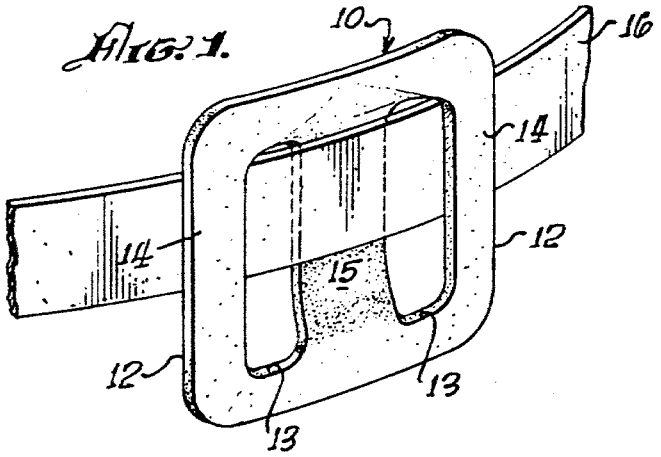
FIG. 1 is a perspective view of the invention shown attached to a belt.

Referring to FIG. 1 of the drawings, there is there shown a preferred embodiment of the invention in the form of a camera holder or support 10 which comprises a substantially rectangular member or strip 11 made of rubber or other elastic material having transverse side edges 12. The holder 10 is provided with a pair of transverse slots 13 which are disposed inwardly from the edges 12 in generally parallel relation therewith to form a pair of flaps 14 and a median center strip 15 which thus forms the central portion of the holder 10.

Figure 2:
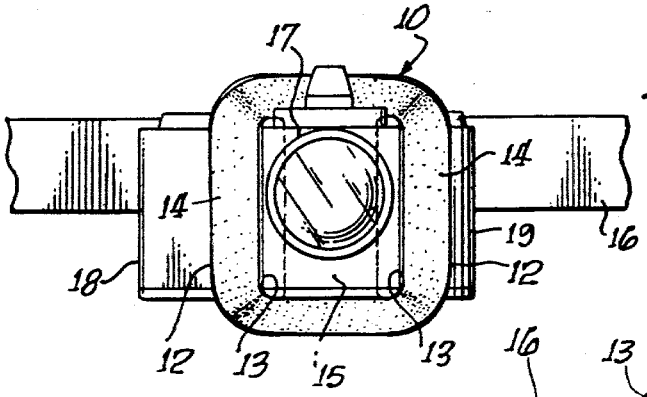
FIG. 2 is front elevation of the same with addition of supported camera.

As shown in FIG. 1, the holder 10 is adapted to be slipped on a belt 16 by threading the belt 16 behind the flaps 14 and in front of the median center strip 15. The holder 10 is adapted to support a camera such as the camera 17 shown in FIG. 2. In general, the holder 10 can be used with any camera having laterally extending body portions such as a 35 mm camera of the single lens reflex type. The mounting of the camera 17 on belt 16 is quite simple and requires only that one extended portion 18 of the camera 17 is initially inserted thru one of the slots 13 in member 10. This places the adjacent flap 14 over said one extended portion 18 of the camera 17. Since the flaps 14 are narrower than the extended portions 18, 19 of the camera 17 the other flap 14 is then stretched to encompass the other extended portion 19 of the camera 17, securing it to the belt 16. Since the inside edges of flaps 14 fit closely to the protruding camera lens, the camera 17 cannot shift from side to side and is cradled securely. When it is desired to remove the camera 17 from the holder 10, one flap 14 is simply stretched aside and the camera 17 can then be extracted from the holder 10.

Figure 3:
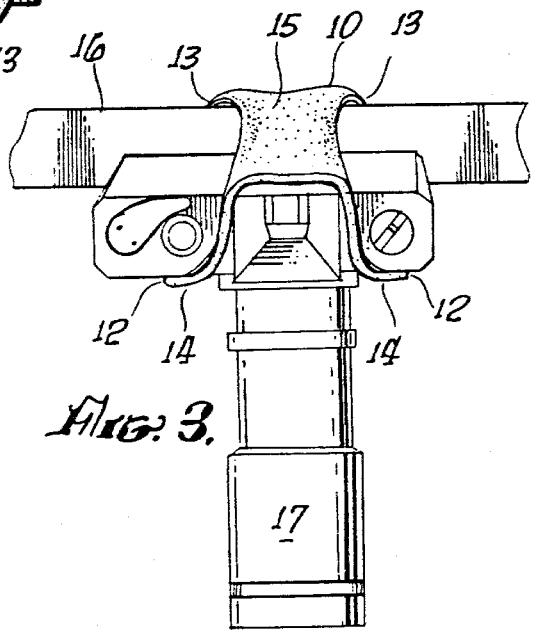
FIG. 3 is a view of the support and camera shown in FIG. 2 rotated downward when used with a long lens so said long lens may hang freely.

As both the belt 16 and the camera 17 are secured by the same slots 13 and flaps 14, a versatility of function is provided. A camera with a short or normal lens can be worn erect. With very short lenses, this position allows the wearer to carry the camera 17 in an inconspicuous fashion under a jacket or other outer garment as it provides a very slim profile. In this manner, for events such as skiing, the camera 17 can be protected by being fitted under the ski parka. When the holder 10 is worn with a narrow belt 16, as shown in FIG. 1, it is evident that the depth of the slots is substantially greater than the width of the belt 16. This facilitates the use of the holder 10 to support a camera 17 provided with long lenses as shown in FIG. 3. Since both the holder 10 and the camera 17 are supported by the same slots 13 and flaps 14, when it is desirable to use a long or zoom lens, the holder 10 is shifted to the hip and raised and the camera 17 rotated downward so the long lens can hang naturally out of the way at the side of the wearer, as seen in FIG. 3. Conversely, should the wearer desire to partake of strenuous sports such as ski jumping, acrobatics or horseback riding, where an up and down motion would cause the camera to bounce, a wider belt 16, approximating the depth of the slots 13 can be used to tightly secure the camera to the body.

Further, with most cameras which fit this belt support device, the slots 13 are each dimensioned in a manner to fit the camera tightly enough so that if for any reason, one flap 14 should tear or come loose from the camera 17, the other flap 14 would temporarily hold the camera until the wearer could become aware that there was a problem.

I claim:

1. A holder for supporting a camera of the type having laterally extended body portions on a belt when worn by a user, said holder comprising a strip-like member of elastic material provided with a pair of slots dimensioned to receive a belt therethrough with each of said slots also being adapted to simultaneously receive a corresponding one of the extended body portions of a camera whereby a camera can be firmly gripped and supported on a user's belt.

2. A holder according to claim 1, wherein the elastic member has a generally rectangular configuration and the slots are disposed in generally parallel relation to the shorter side edges of said rectangular member, each slot being inwardly spaced from the respective side edge of said member and defining a narrow flap which is adapted to overlie and resiliently secure an extending body portion of a camera to a belt worn by a user.

3. A holder according to claim 2, wherein the length of the slots in a direction parallel to said side edges is substantially greater than the width of a belt on which the holder is adapted to be supported whereby the holder and a camera supported thereby is adapted to be pivoted about a belt to a position in which the flaps extend transversely to the face of the belt.

4. A holder according to the claim 2, wherein the length of the slots in a direction parallel to said side edges is only slightly greater than the width of a belt on which the holder is adapted to be supported.

5. A holder according to claim 2, wherein the inside edges of the flaps are positioned close to the protruding lens of a camera adapted to be supported on a user's belt, whereby the flaps act conjointly to prohibit the camera from shifting from side to side, thereby maintaining the security of the camera.

6. A holder according to claim 1, wherein the individual slots are each so dimensioned that one of the flaps is sufficient to retain a camera on a user's belt notwithstanding the failure of the other flap.

* * * * *